US006615552B2

(12) United States Patent
Gillis

(10) Patent No.: US 6,615,552 B2
(45) Date of Patent: Sep. 9, 2003

(54) SEGMENTED ARTICULATED POLE STRUCTURE

(75) Inventor: Robert E. Gillis, 224 W. O'Connor, Menlo Park, CA (US) 94025

(73) Assignee: Robert E. Gillis, Menlo Park, CA (US)

( * ) Notice: Subject to any disclaimer, the term of this patent is extended or adjusted under 35 U.S.C. 154(b) by 0 days.

(21) Appl. No.: 09/728,149

(22) Filed: Dec. 1, 2000

(65) Prior Publication Data

US 2002/0066239 A1 Jun. 6, 2002

(51) Int. Cl.[7] ..... E04H 15/32; E04H 15/34; E04H 15/44

(52) U.S. Cl. ..... 52/83; 52/80.1; 52/81.2; 52/81.3; 135/87; 135/114; 135/121; 135/123

(58) Field of Search ..... 52/83, 80.1, 81.2, 52/82, 79.1, 99.12; 135/90, 124, 135, 136, 147, 151, 156, 87, 123, 95, 125, 99, 126, 100, 127, 121, 128, 122, 130, 131, 132, 138, 143, 145, 114

(56) References Cited

U.S. PATENT DOCUMENTS

| | | | | |
|---|---|---|---|---|
| 3,314,630 A | | 4/1967 | Lewis, Sr. | |
| 3,376,879 A | | 4/1968 | Huddle | |
| 3,749,107 A | | 7/1973 | Laberge | |
| 3,834,410 A | | 9/1974 | Gillis | |
| 3,863,659 A | | 2/1975 | Gillis | |
| 3,986,519 A | | 10/1976 | Gillis | |
| 4,099,533 A | | 7/1978 | Gillis | |
| 4,175,305 A | | 11/1979 | Gillis | |
| 4,265,259 A | | 5/1981 | Gillis | |
| 4,265,260 A | | 5/1981 | Gillis | |
| 4,308,647 A | | 1/1982 | Gillis | |
| 4,414,993 A | | 11/1983 | Gillis | |
| 4,706,696 A | * | 11/1987 | Gillis | 135/102 |
| 4,809,726 A | | 3/1989 | Gillis | |
| 4,944,322 A | | 7/1990 | Gillis | |
| 5,388,311 A | | 2/1995 | Solbeck | |
| 5,477,876 A | | 12/1995 | Moss | |
| 5,642,750 A | | 7/1997 | Brown et al. | |
| 6,145,527 A | | 11/2000 | Gillis | |

FOREIGN PATENT DOCUMENTS

| | | |
|---|---|---|
| DE | 2521913 | 11/1976 |
| GB | 1103575 | 5/1965 |

OTHER PUBLICATIONS (5) Sierra Designs Catalogs depicting tents and connectors, Sierra Designs, 1255 Powell Street, Emeryville, California 94608.

(1) Recreational Equipment Inc. Catalog depicting tents and connectors, 1700 45th Street East, Summer, Washington 98390.

Mountain Hard Wear Catalog, pp. 6–15 depicting tents and connectors, 950 Gilman Street, Berkeley, California 94710.

(2) The North Face brochures, pp. 8–17 and pp. 30–37, The North Face, 999 Harrison Street, Berkeley, California 94710.

* cited by examiner

*Primary Examiner*—Jeanette Chapman

(74) *Attorney, Agent, or Firm*—Townsend and Townsend and Crew LLP

(57) ABSTRACT

A segmented, articulated pole member structure is constructed of a plurality of pivotally interconnected, pole segments. The pole segments are arranged in an alternating or offsetting fashion such that in their disassembled state they may be folded into a compact bundle for storage. In the assembled state, adjacent pole segments are retained under tension in fixed angular position relative to each other by a pivoting connection and an engagement loop or similar structure. Applications for the pole member structure include the construction of flexible structures such as tents and shelters, and support frames for mounting, supporting, or suspending articles in a desired shape.

12 Claims, 6 Drawing Sheets

SEGMENTED ARTICULATED POLE STRUCTURE

BACKGROUND OF THE INVENTION

1. Field of the Invention

The invention relates generally to structural members of the type typically used in flexible structures, such as tents, shelters and the like, and more particularly to resilient pole members. The invention further relates to articulated structural members which may find use as a frame in support applications, such as for mounting, supporting or suspending articles in a desired shape.

2. Description of Related Art

In the area of flexible structures, including tents, shelters, and the like, it has long been common practice to employ one or more resilient pole members. Typically, the pole members are held under tension in a desired shape to define the structure and to support a membrane defining a sheltered space. Examples include dome type tents, vault type shelters, and the like. The inventor named herein has in the past invented numerous flexible structures employing a variety of resilient pole members and arrangements. Some of these are shown and described in U.S. Pat. Nos. 3,863,659; 3,986,519; 4,099,533; 4,265,260; 4,265,259; 4,414,993; 4,706,696; and 4,944,322.

Typically, the resilient pole members employed are constructed of aluminum, graphite, or similar resilient materials. Both one piece and segmented pole members are known. One piece pole members have the advantage of strength and ease of assembly. However, segmented pole members have the advantage that they can be disassembled and compactly stored, which may be important in certain applications, such as lightweight backpacking tents.

Typically segmented pole members have the segments connected end to end, for example using a male-female connection and a friction fit. Hub connections are also known and are shown in one or more of the above-identified Patents. In order to prevent the loss of individual segments, which would render a pole member useless, and to assist in the pole assembly process, it has been known to connect the individual segments together in a more or less permanent fashion, for example using a "shock-cord." A "shock-cord" is typically used with pole members that are hollow and is typically a thin elastic band or cord that fits through the hollow centers of the pole member segments and is knotted at each end. While a shock-cord advantageously tends to avoid the loss of pole segments, it does not necessarily add any strength to the pole member structure itself.

Generally, resilient pole members of the type commonly used in constructing flexible structures such as tents are not very flexible in the applications to which they can be put. In order to be easily tensioned, they are typically made of light weight, resilient, and non-rigid materials. If such pole members are to be used with larger structures, heavier and more rigid materials must be used to withstand the increased loading of the elements, as well as the increased weight of the membrane or membranes defining the sheltered space. Heavier and more rigid pole members are significantly more difficult to tension, i.e., bend. Significant effort, perhaps aided by tools such as tensioners, is typically required to tension such pole members during assembly of the structure. Moreover, there can be danger involved in the disassembly of flexible structures employing such heavier, more rigid pole members due to the significant tensioning forces that are released when the structure is disassembled.

For the same reasons, such pole members are typically not useful in other support applications, such as providing a frame for mounting or suspending articles in a desired shape. For example, such pole members are typically not suitable for use as a trellis for creeping vines, or as a frame for supporting flowers or balloons in a selected shape.

The present invention provides a segmented, articulated pole member structure that is light in weight, compact to store, strong, easily assembled and disassembled, and flexible in application. It will find application in constructing both small and large flexible structures, as well as a support frame for mounting, suspending or supporting articles in a desired shape.

SUMMARY OF THE INVENTION

The features and advantages of the present invention reside in a pole member structure having a plurality of segments. Each segment has a pivoting connection with each adjacent segment. Each segment also has a connector for selectively connecting the pole segment with one of its adjacent pole segments so that adjacent pole segments are retained in a fixed angular position relative to their pivoting connection when the pole member structure is tensioned.

The individual pole segments may be rigid or resilient, and the connector may be a ring, loop, or other suitable connector. The ends of the adjacent segments may overlap and the longitudinal axes of the adjacent segments may be offset to facilitate folding the pole member structure into a compact bundle for storage.

In another aspect of the invention, the pole member structure is provided with base supports to engage its opposite ends and support it in an upright position at a selected angle. Such base supports may include fabric pockets or the like in a flexible structure, or more rigid supports such as rigid tubes or stakes to support the pole member structure on the ground or a floor or other base. In this aspect of the invention, the pole member structure can be used as a frame for mounting, supporting or suspending articles in a desired shape.

In yet another aspect of the invention, a plurality of articulated, segmented pole member structures are tensioned and arranged in a desired shape to define a flexible structure such as a dome or vault. A membrane is connected to at least some of the pole member structures to define a sheltered space.

DETAILED DESCRIPTION OF THE PREFERRED EMBODIMENT

Figure 1:
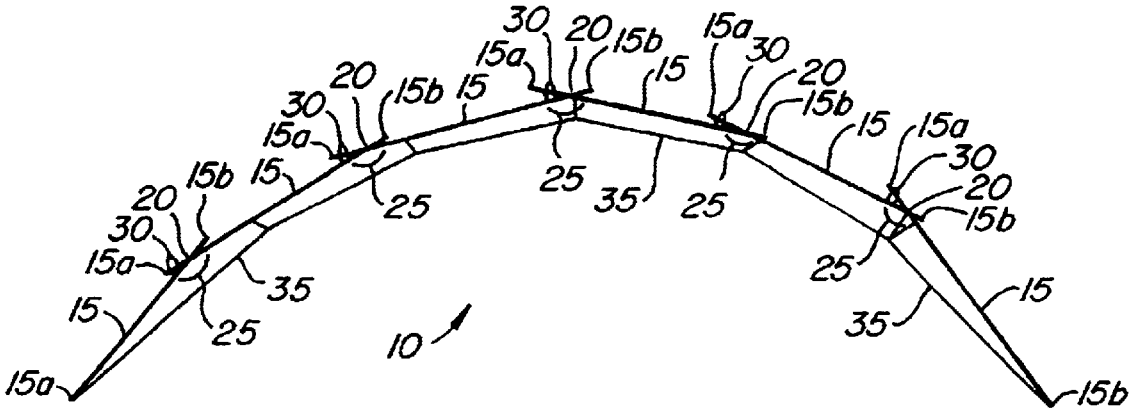
FIG. 1 is a side elevational view of one preferred embodiment of the segmented articulated pole member structure of the invention.

FIG. 1 illustrates one preferred embodiment of the articulated pole member structure of the invention. In this preferred embodiment, the pole member structure 10 comprises a plurality of interconnected pole segments 15. Each pole segment 15 is preferably connected to its adjacent pole segments 15 by a pivoting connection 20, thus permitting adjacent pole segments 15 to form an angle 25 about the point of pivot connection. It will be appreciated that the value of the angle formed between adjacent pole segments 15 will vary depending on the degree to which the pole member structure 10 as a whole is bent or otherwise shaped or tensioned. However, it is preferred and envisioned that the angle 25 between adjacent pole segments 15 will remain relatively stable for any given bending position of the pole member structure 10.

The pivoting connection 20 may be made in numerous suitable ways which will be appreciated by persons skilled in the art. The type of pivoting connection selected will depend upon the materials and stiffness of the pole segments 15, the range of angles 25 desired, the desired strength of the connection, and other factors that will be apparent to persons skilled in the art. In an embodiment employing standard tent pole materials and dimensions for the pole segments 15, for example, hollow aluminum, graphite or other known tent pole materials, the pole segments 15 will tend to be relatively light and resilient. In such cases, the pivoting connection can be made as simply as by wrapping a layer of cord or similar material around the adjacent pole segments at the pivot point. Alternatively, the pole segments may be provided with aligned holes and a pin, rivet or ring may be used. In embodiments employing heavier and less resilient or even rigid materials for the pole segments, for example in large shelter or support structures, a heavier connection such as a bolt extending through a hole or sleeve and secured with a nut may be appropriate. Numerous other connection alternatives are also suitable provided they are able to create a pivoting connection between adjacent pole segments.

Preferably the pole segments 15 are arranged relative to one another so that there is some amount of overlap between the ends of each adjacent pole segment. Thus, as illustrated in FIG. 1, each pole segment 15 has ends 15*a* and 15*b*. Each pole member segment 15 is arranged so that its ends 15*a* and/or 15*b* slightly overlap the ends 15*a* and/or 15*b* of its adjacent pole segments. The amount of overlap is dependent upon a number of design factors including the stiffness of the pole segments 15, the type of pivoting connection and tensioning means employed, and the degree to which the overlapping portion is desired to be used as a tensioning lever, as described hereinafter. It should be noted, however, that not all pole member structures embodying the invention need necessarily have overlapping pole segments.

In an embodiment with overlapping pole segments 15, as shown in FIG. 1, each pole segment 15 may be provided with a ring or loop 30. Preferably ring or loop 30 will be located nearer one end, e.g., 15*b*, of the pole segment than the other end, e.g., 15*a*, and will be located adjacent the area of overlap to enable engagement with the overlapping end 15*a* or 15*b* of the adjacent pole segment 15. As shown in FIG. 1, the overlapping ends 15*a* or 15*b* of pole segments 15 will preferably extend through and be engaged by the rings or loops 30 of the adjacent pole segments. The overlapping ends may thus be employed as levers to assist in tensioning the pole member structure 10 in a selected bent shape, for example a dome or vault shape, and are held in the tensioned position by the rings or loops 30.

Figure 2:
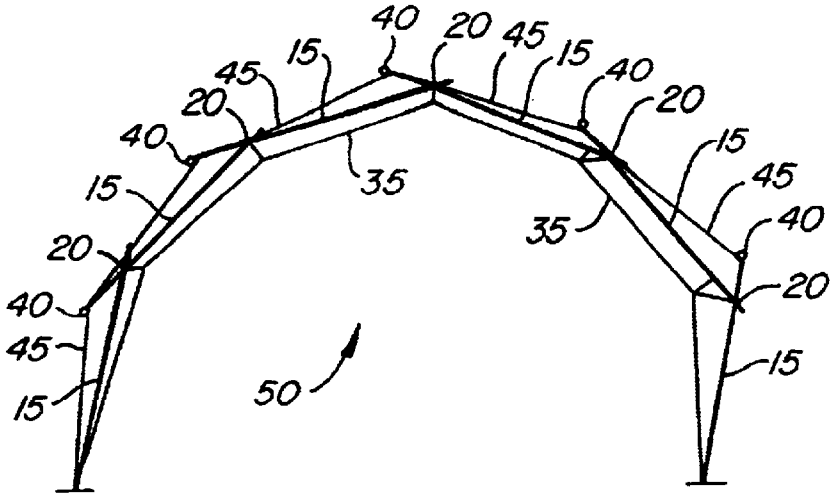
FIG. 2 is a side elevational view of another preferred embodiment of the articulated pole member structure of the invention.
Figure 4:
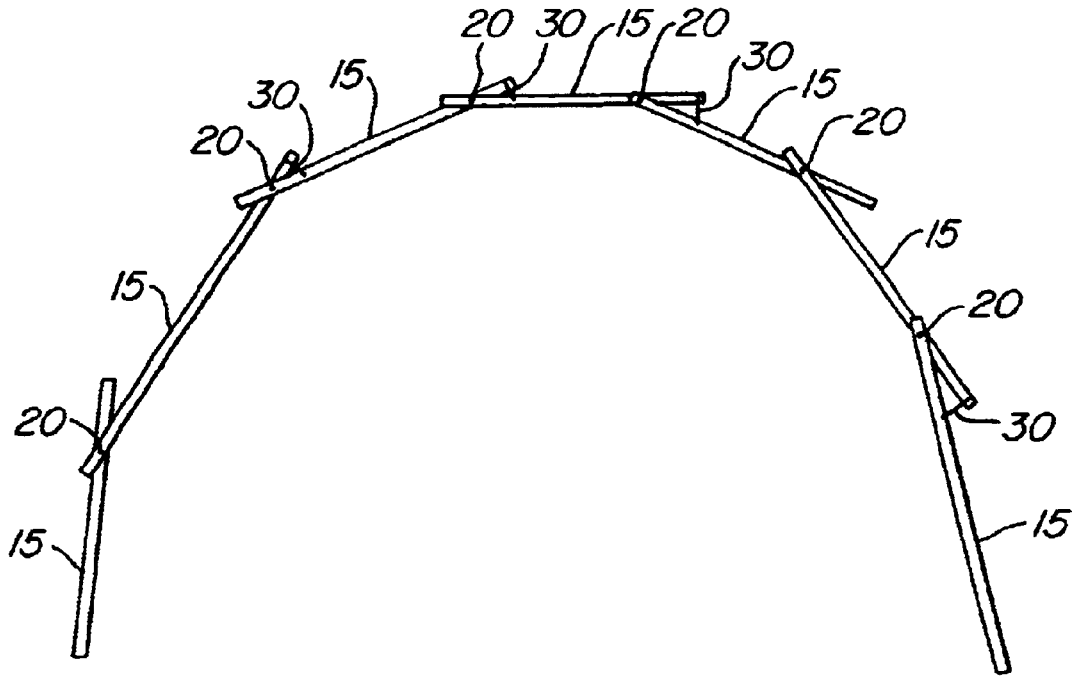
FIG. 4 is a side elevational view of another preferred embodiment of the articulated pole member structure of the invention.
Figure 5:
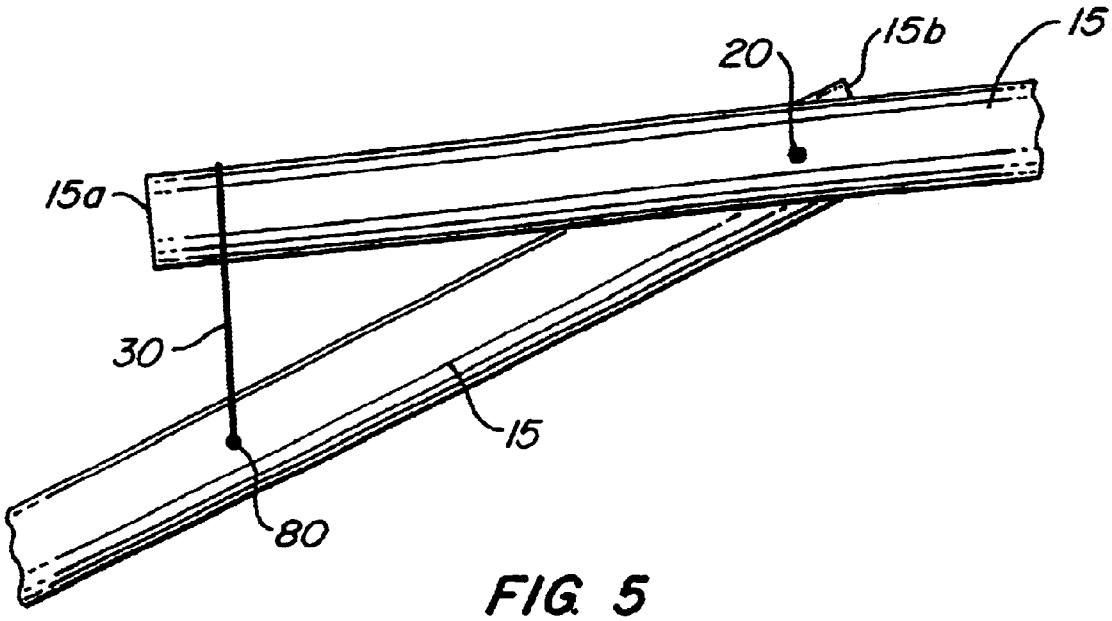
FIG. 5 is a partial side elevational view of an enlarged section of the articulated pole member structure of FIG. 4 showing a preferred form of connection between adjacent pole segments.

Many different materials and manners of connection are suitable for the rings or loops 30, depending upon the material and stiffness of the pole segments, the degree of tension forces expected, and others that will be appreciated by those skilled in the art. For example, in embodiments as illustrated in FIGS. 1 and 2 using relatively light, resilient materials for the pole segments, such as typical tent pole materials and dimensions, the rings or loops 30 are suitably a loop of fabric or cord affixed to the pole segment 15 in any suitable manner. In embodiments requiring greater strength, it may be desirable to employ a metal ring extending through a hole in the pole segment. In still other embodiments, such as shown in FIGS. 4 and 5, it may be desirable to employ an even stronger material and connection, for example, metal strapping or cable fixedly connected to the pole segments 15. Alternatively, other connection means such as hooks, plugs or any other secure attachment may be used.

In embodiments in which conventional tent pole materials and dimensions are employed, tensioning the pole member structure 10 may not require significant force. However, when the pole member structure or structures are employed to construct larger structures, or when stiffer and less resilient materials are employed for the pole segments, it may take considerable force to tension the pole member structure or structures. In that instance, the overlapping ends of the adjacent pole segments 15 advantageously function as tension levers and provide mechanical assistance to tension individual segments of the pole member structure 10 without having to tension the entire structure at once. For example, the opposite ends of the pole member structure 10 may be secured to a base surface or the ground by stakes, by insertion into the surface of the ground or base directly, by insertion into a hollow tube, opening, or the like in the base or ground, or by any other suitable means. The individual segments of the pole member structure may then be tensioned by bending (tensioning) the overlapping portions of the pole segments, using them as tension levers, and securing the ends with the loops or rings 30, or other suitable connectors, as described.

Additional strength and rigidity may be imparted to the pole member structure 10 by providing a tension web 35. The tension web 35 may be constructed of a plurality of materials and may be secured to the pole member structure 10 in a variety of ways, as described in the inventors' co-pending U.S. patent application Ser. No. 09/079,246, which is incorporated herein by reference. For example, the tension web 35 may comprise a relatively rigid, non-resilient cord or section of material secured to each end of the pole member structure 10, which extends beneath the pole member structure 10 and runs from end to end substantially co-planar with the pole member structure 10, and which is connected to the pole segments 15 at intermediary points between the ends by straps or the like.

FIG. 2 illustrates another preferred embodiment of the pole member structure of the invention designated 50. The embodiment of FIG. 2 is similar to that of FIG. 1 and like structures are designated with the same references. This preferred embodiment may employ a somewhat different tensioning apparatus than the tensioning levers approach of the embodiment of FIG. 1, or may use the tensioning levers approach. In this embodiment, an overlapping end 15*a* of each pole segment 15 is provided with an eye 40. A resilient cord or similar device 45 is secured to an eye 40 of an end pole segment 15 of the pole member structure 50 in conventional fashion, for example by knotting it, and is passed through each of the other eyes 40 to an end of the opposite end pole segment 15 of the pole member structure 50, where it is secured, again in conventional fashion. A tension web 35, as previously described, is coupled to the pole member structure at a plurality of intermediate points between its opposite ends. By tensioning the cord 45, the entire pole member structure 50 may be bent into a desired shape under tension due to the opposing forces generated by cord 45 and tension web 35. If desired, connections may also be made between the overlapping ends of corresponding adjacent pole segments 15 as previously described to provide additional tension and structural rigidity.

Additionally, the structure may be deployed with the tension web 35 or without it and employing only connections between the overlapping ends of corresponding adjacent pole segments 15 to provide tensioning of the structure, similarly to the embodiment of FIG. 1. In either event, because the resilient cord 45 imparts an outward force to the structure 50, it also functions to automatically deploy the structure 50. Thus, when the pole segments 15 are released from a folded bundle, the outward force imparted by the resilient cord 45 tends to cause the structure 50 to automatically "open up." The outer ends of the outside pole segments of the structure can then be secured to the ground or a base as described previously, and the overlapping ends of the adjacent pole segments used as levers to tension the structure 50.

Figure 3:
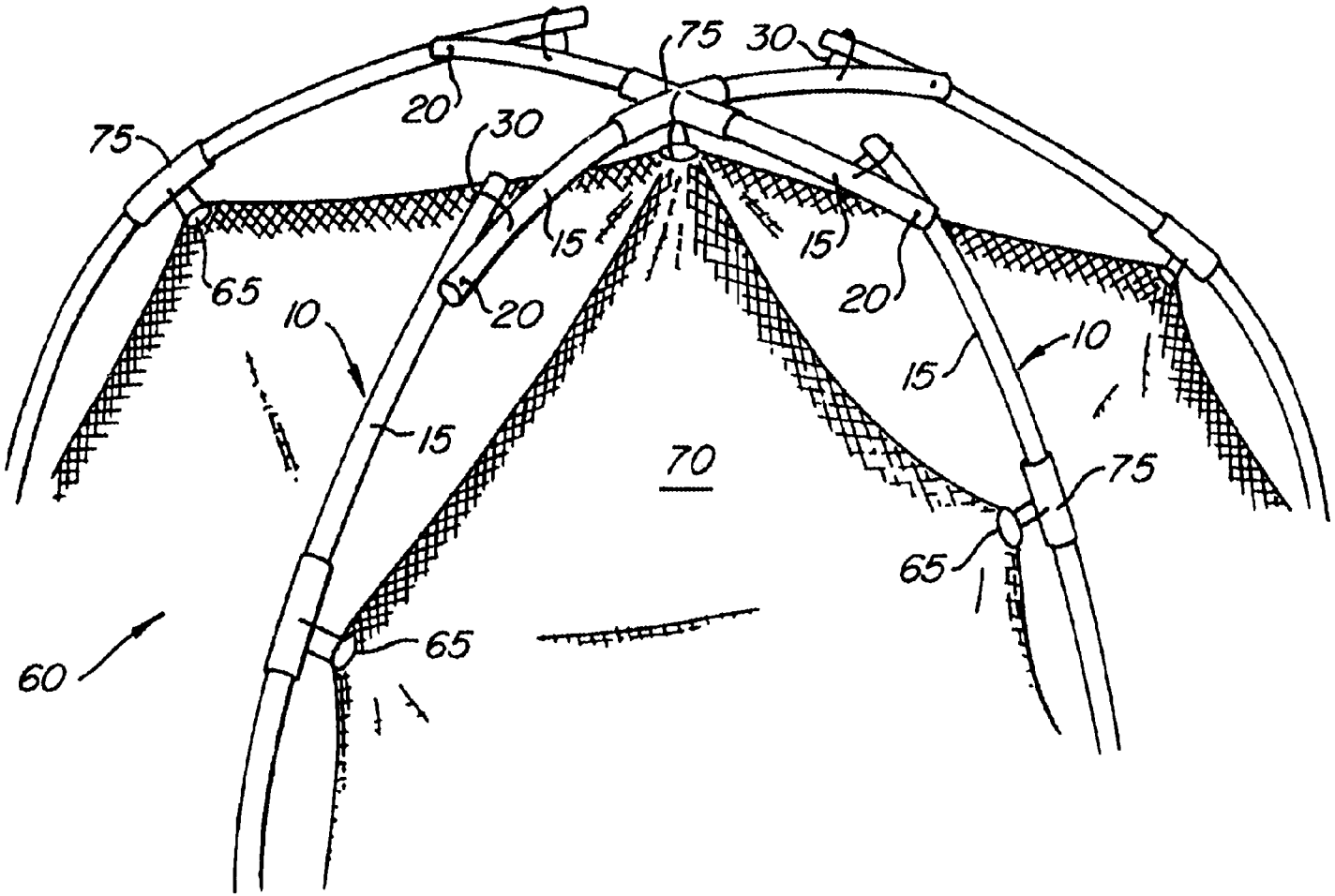
FIG. 3 is a side elevational view of a flexible shelter structure employing articulated pole member structures of the invention.

FIG. 3 illustrates an exemplary flexible shelter structure 60 constructed employing segmented articulated pole member structures embodying the invention. In this particular embodiment, a plurality of pole member structures 10 are constructed as described previously and are secured to the ground or a base in any suitable fashion, also as described previously. The pole members 10 may be arranged in a crossing configuration as illustrated or in a non-crossing configuration, if desired (see FIG. 9 for example). A membrane 70, which may be typical tent or tarp material such as nylon or polypropylene for example, underlies and is coupled to the pole member structures 10 at a plurality of locations using connectors 65. The membrane 70 not only acts to tension the pole member but also defines a sheltered space. The membrane 70 may be connected to the pole member structures 10 using any suitable means, including those shown and described in the inventors' co-pending U.S. patent application Ser. No. 09/608,063, and issued U.S. Pat. Nos. 3,986,519; 4,099,533; 4,175,305; 4,265,260; 4,265,259; 4,308,647; and 4,414,993, which are incorporated herein by reference. The sheltered space may be configured in numerous ways by simply changing the orientations and relative sizes of the pole member structures 10 and the membrane 70. If desired, edges and/or corners of the membrane 70 may also be secured to the ground or a base by conventional means such as stakes or other known means. Depending on the lengths of the pole member structures 10, it may be desirable to construct individual pole segments 15 in sections joined via hubs 75 or the like. Similarly, it may be desired to construct crossing points of the pole member structures using hubs 75 or similar fittings.

FIGS. 4 and 5 illustrate another preferred embodiment which is a variation of the embodiment illustrated in FIG. 1. The embodiment illustrated in FIG. 1 envisions primarily the use of pole segments 15 constructed of a fairly light, resilient material, such as typical tent pole material. Thus, it is contemplated that the embodiment illustrated in FIG. 1 will find primary use in constructing smaller, lighter-weight flexible structures, including shelter structures, such as shown in FIG. 3, or support structures for relatively small and light-weight articles, such as balloons or the like. The embodiment of FIGS. 4 and 5 envisions the use of relatively heavier and more rigid materials, such as two by four lumber or rigid plastics for the pole segments 15, and it is contemplated such embodiments will find use primarily in constructing larger, stronger shelters or support structures. For example, such structures could be used as trellises or archways in gardening or landscaping applications, or as frames for supporting a variety, of heavier articles via hooks, straps or the like.

In the embodiment shown in FIGS. 4 and 5, elements similar to those in the embodiment of FIG. 1 are designated with the same references. As described previously, the use of heavier, more rigid materials for the pole segments 15 will generally require stronger connections for the pivot connections 20. Suitable connection apparatus includes metal bolts and nuts, washers, and perhaps hollow metal inserts or sleeves as well. For example, the pivot connection 20 shown in FIG. 5 may be constructed by drilling a hole through pole segments 15 at the desired pivot point and, if desired, inserting a hollow metal tube or sleeve. A metal bolt may then be inserted through the hole or tube and secured with a nut and perhaps washers, as desired. Preferably, the bolt will turn freely in the hole or tube insert so that a pivoting connection is established between the pole segments 15.

Similarly, a stronger loop or ring 30 connection is required in the embodiment shown in FIGS. 4 and 5. For example, a hole 80 may be drilled in the pole segment 15 at the desired location for the loop or ring 30. The loop or ring itself may be constructed of cable, wire, strong rope, or metal strapping for example. The loop or ring 30 may be passed through the hole 80 and coupled to itself in conventional fashion, such as by the use of cable ties or the like. If desired, a notch or other loop engaging surface or structure (not shown) may be provided near the overlapping end 15*a* of the adjacent pole segment to assist the loop or ring in securely engaging the overlapping end, and to avoid slippage.

Figure 6:
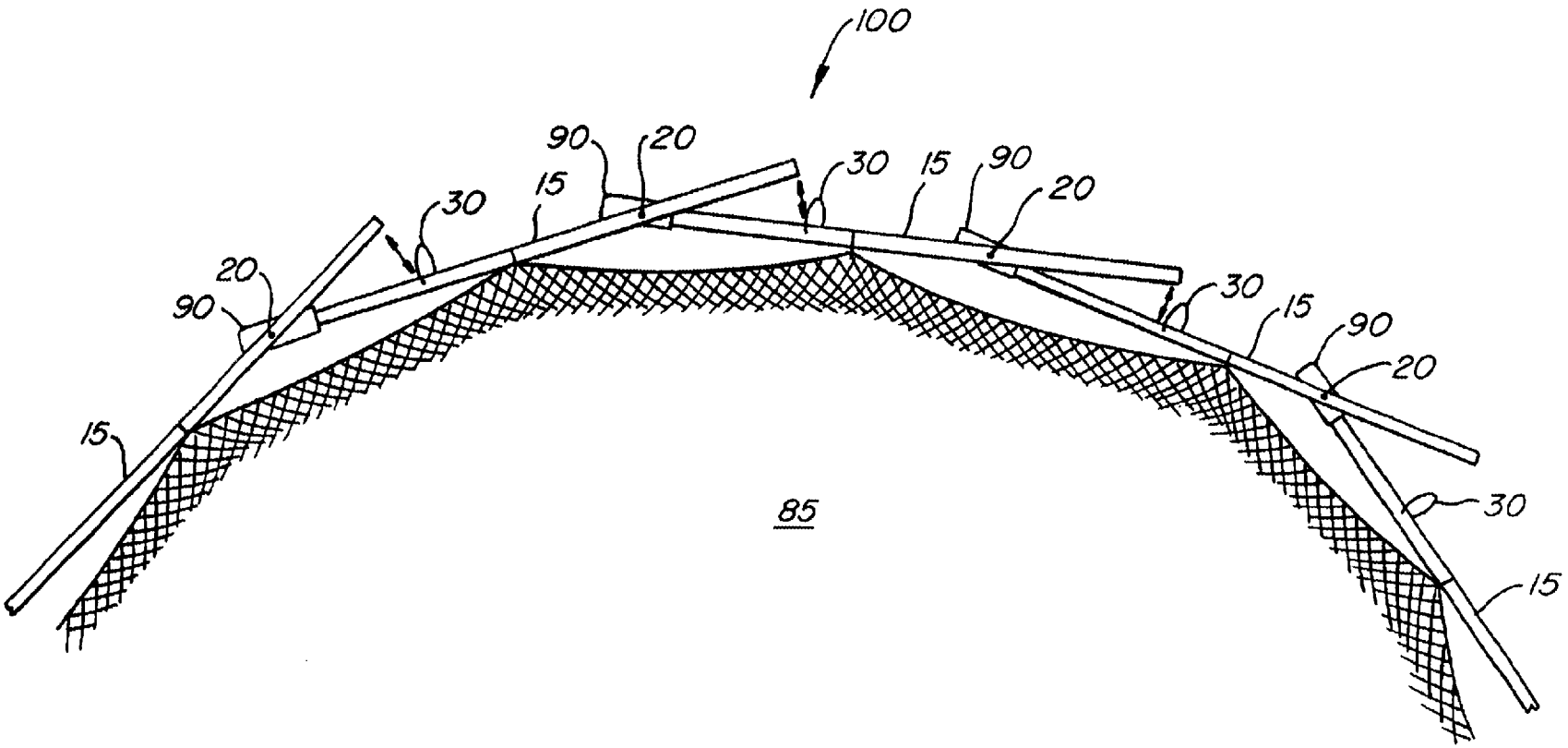
FIG. 6 is a side elevational view of another preferred embodiment of the articulated pole structure of the invention with a membrane defining a sheltered space.

Referring to FIG. 6, another preferred embodiment is illustrated. In this embodiment, adjacent pole segments 15 are interconnected by pivotal connections 20 and are provided with loops or rings 30 to engage the overlapping ends of adjacent pole segments, as in the embodiments of FIGS. 1, 2, 4, and 5. However, in this embodiment, the pole segments 15 are not directly interconnected at the pivot points. Rather, each pole segment 15 is preferably provided with a hub or pole fixture 90 at the pivot point. The hub or pole fixture 90 is pivotally connected to its associated pole segment 15 via a pivoting connection, which may be any of the types previously identified or any other suitable means. Preferably, each hub or fixture 90 has an open end into which the end of an adjacent pole segment is inserted to complete the pivoting connection between adjacent pole segments. Tensioning of the structure will generally maintain a satisfactory connection between the ends of the pole segments and the corresponding hubs. However, if desired, the ends of the adjacent pole segments 15 and the hubs or fixtures 90 can be engaged via friction fit or hardware such as cotter pins, bayonet attachments or the like can be used. After a pivoting connection is made, the overlapping ends of adjacent pole segments 15 can be employed as tension levers as previously described to tension the pole member structure 100, and will be retained by loops or rings 30 or other suitable connectors as previously described. If desired, a membrane 85 comprising conventional tent or tarp material or other tension means may be coupled to and underlie the pole member structure 100 to define a sheltered space. The membrane may be coupled in any suitable fashion, including via loops, hooks, and/or the means shown and described in the inventor's above-identified issued U.S. patents and pending applications. It will be appreciated, and it is preferred, that the ends of the pole member structure 100 are secured to a base or the ground in any suitable manner, such as those previously described, in order to retain the tensioning of the pole, and that the membrane itself will provide tensioning forces to the pole member structure as well. While this embodiment has been described as providing a flexible shelter structure, it will also be appreciated that the same structure without the membrane, but perhaps with other tensioning means such as a cable, tension web or the like, will find application as a support frame structure. Further, it will be appreciated, that while only one pole member structure 100 is illustrated, multiple pole member structures 100 may be employed to construct a flexible shelter or support structure, for example, as shown in FIGS. 3 and 9.

Figure 7:
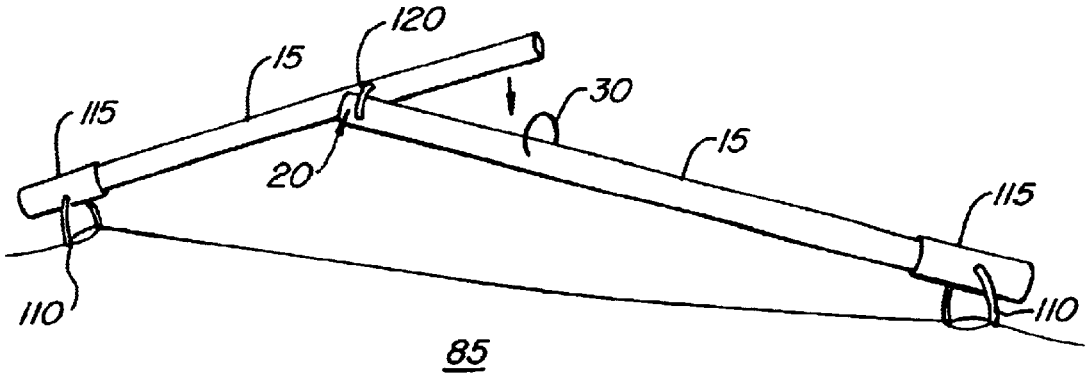
FIG. 7 is a partial side elevational view of an articulated pole structure of the invention showing another preferred form of connection between adjacent pole segments.
Figure 8:
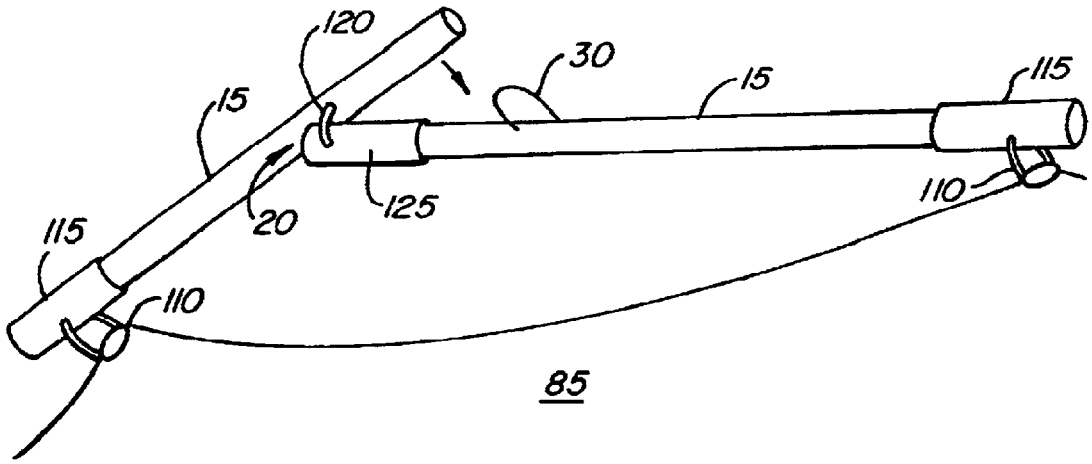
FIG. 8 is a partial side elevational view of an articulated pole structure of the invention showing another preferred form of connection between adjacent pole segments.

FIGS. 7 and 8 illustrate exemplary alternative arrangements for providing pivoting connections between adjacent pole segments 15. Additionally, FIGS. 7 and 8 illustrate alternative levering arrangements that can also be used to tension multiple or single segment pole member structures, such as shown in FIGS. 3 and 9. As shown in FIG. 7, two adjacent pole segments 15 are arranged with their proximal ends overlapping. One pole segment 15 is provided with a connector 30, which may be a ring, loop or other structure suitable for engaging the free end of the other pole segment 15 and retaining it under tension. The overlapping free end of pole segment 15 to be engaged by the connector 30 functions as a lever to tension a pole member structure of which the pole segments 15 form a portion. If desired, the distal ends of pole segments 15 may be coupled to other portions of a pole member structure via hubs 115 or similar connectors. The two pole segments 15 have a pivotal connection 20, which may comprise corresponding holes through the pole segments 15 and a ring 120 or other suitable connector hardware, as described herein previously. The lever arrangement shown may be coupled to a membrane 85 via connectors 110 both as previously described herein. In the arrangement of FIG. 7, the pole segments are essentially permanently coupled via the pivotal connection 20.

It is not necessary that pole segments 15 be permanently intercoupled however. A similar levering arrangement is illustrated in FIG. 8 in which the pole segments are not permanently coupled. This arrangement is essentially the same as shown in FIG. 7 except that in this arrangement the pivotal connection 20 between the pole segments is made between one pole segment 15 and a hub or fixture 125. Hub or fixture 125 has an open end adapted to accept the proximal end of the pole segment 15 having connector 30. Once the proximal end of pole segment 15 is inserted into the hub or fixture 125, the overlapping free end of the other pole segment 15 can be used as a lever to tension the pole member structure of which the levering arrangement forms a portion, as previously described. In this arrangement, the adjacent pole segments can be detached from each other to facilitate packing and transportation, among other things.

Figure 9:
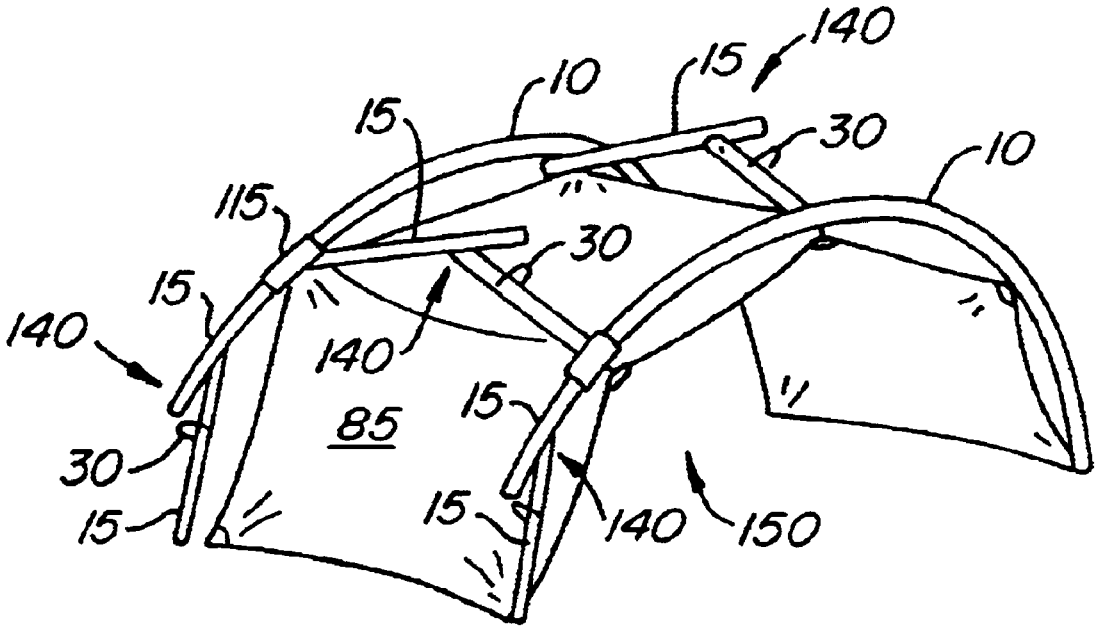
FIG. 9 is a perspective view of a flexible shelter structure embodying a variation of the segmented articulated pole member structures of the invention.

FIG. 9 shows a flexible shelter structure 150 comprising two single segment pole member structures 10 which are arranged as essentially parallel arches to form a sort of vault or tunnel-shaped structure. A levering arrangement 140 comprising adjacent pole segments 15, essentially as shown in FIGS. 7 and 8, is used to tension the pole member structures 10. In addition, levering arrangements 140 are also arranged transversely between pole member structures 10 to maintain spacing between the pole member structures and provide lateral rigidity to the structure 150. A membrane 85 coupled to the structure provides additional tensioning and defines a sheltered space.

It will be appreciated by persons skilled in the art from the foregoing descriptions that the exemplary pole member structures described can be easily and quickly disassembled by simply releasing the overlapping ends of the pole segments from their associated rings or loops. In their disassembled state, the pole member structures fold into compact packages for storage or transportation at only a fraction of their assembled size. The ability to fold compactly is preferably facilitated by alternating sides or offsetting the longitudinal axes of adjacent pole segment overlapping ends which are in contact for making the preferred pivoting connections. Thus, one end of a given pole segment will have one side in contact with a side of an end of one adjacent pole segment for making pivoting connection, and the opposite end of the given pole segment will have its opposite side in contact with a side of another adjacent pole segment for making pivoting connection. Thus, the longitudinal axes of adjacent pole segments will preferably be offset. Additionally, it will be appreciated that since preferably the various pivoting connections, loops or rings, etc. are integral to the structure, there is less chance of lost parts inhibiting or delaying disassembly and reassembly.

The foregoing detailed description of the preferred embodiments illustrate and highlight the characteristic features and advantages of the invention. It will be apparent to persons skilled in the art that numerous variations to the particular embodiments may be made with routine skill. For example, various dimensions, materials, and connection apparatuses may be employed while retaining the characteristic features and advantages of the invention. Accordingly, the foregoing description is not intended to delimit the scope of the invention, which is defined solely by the appended claims.

What is claimed is:

1. A pole member structure comprising:

a plurality of pole segments, each pole segment having a first end and a second end;

said first end of a first pole segment overlapping a said second end of a second adjacent pole segment by a selected amount and forming a tension lever;

a plurality of pivoting connections, each pivoting connection connecting a said first end of a said first pole segment to a said second end of a said adjacent second pole segment; and said second end of each said adjacent second pole segment having an additional connector to selectively engage said tension lever formed by a said first overlapping end of a said first pole segment, whereby said first and second pole segments are maintained in a selected angular relationship relative to said pivoting connection when said pole member structure is tensioned.

2. The pole member structure of claim 1 wherein said pole segments are rigid.

3. The pole member structure of claim 1 wherein said pole segments are resilient.

4. The pole member structure of claim 1 wherein said pivoting connection comprises at least one element from the group: ring, pin, bolt, cord, material, hub.

5. The pole member structure of claim 1 wherein said additional connector comprises a ring adapted to engage a said tension lever formed by a first overlapping end of a said first pole segments.

6. The pole member structure of claim 1 wherein:

said additional connector adapted to engage a said tension lever formed by a said first overlapping end of a said first pole segments comprises at least one element from the group: ring, hook, plug, clamp, clasp, toggle.

7. The pole member structure of claim 1 wherein:

each of said plurality of pole segments has a longitudinal axis; and said longitudinal axis of each said pole segment is offset with respect to said longitudinal axis of each adjacent pole segment whereby folding the pole member structure into a compact bundle is facilitated.

8. The pole member structure of claim 1 having first and second pole ends and including:

a first base support for engaging said first pole end; and a second base support for engaging said second pole end;

said first and second base supports supporting said pole member structure in an upright position at a desired angle.

9. A flexible structure comprising:

a plurality of pole member structures as set forth in claim 1, said plurality of pole members arranged and tensioned to define a selected shape;

a membrane connected to at least some of said plurality of pole member structures and defining a sheltered space.

10. The flexible structure of claim 9 wherein said pole members are arranged in mutual crossing relationship.

11. The flexible structure of claim 10 wherein said selected shape is substantially dome shaped.

12. The flexible structure of claim 9 wherein said selected shape is substantially vault shaped.

* * * * *

UNITED STATES PATENT AND TRADEMARK OFFICE

CERTIFICATE OF CORRECTION

PATENT NO. : 6,615,552 B2
DATED : September 9, 2003
INVENTOR(S) : Robert E. Gillis It is certified that error appears in the above-identified patent and that said Letters Patent is hereby corrected as shown below:

Column 9,
Line 13, change "segments" insert -- segment --.

Signed and Sealed this

Eleventh Day of November, 2003

JAMES E. ROGAN
*Director of the United States Patent and Trademark Office*